US007940225B1

(12) United States Patent
Ball et al.

(10) Patent No.: US 7,940,225 B1
(45) Date of Patent: May 10, 2011

(54) ANTENNA WITH SHAPED DIELECTRIC LOADING

(75) Inventors: Thomas A. Ball, Bloomington, IN (US); Jeffrey M. Snow, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 924 days.

(21) Appl. No.: 11/821,475

(22) Filed: Jun. 19, 2007

(51) Int. Cl.
*H01Q 21/00* (2006.01)
*H01Q 13/00* (2006.01)
*H01Q 1/36* (2006.01)

(52) U.S. Cl. ..... 343/725; 343/773; 343/908

(58) Field of Classification Search ..... 343/700 MS, 343/725, 773, 908
See application file for complete search history.

(56) References Cited

U.S. PATENT DOCUMENTS

| | | | | |
|---|---|---|---|---|
| 3,750,182 | A | 7/1973 | Kernweis | |
| 3,935,577 | A | 1/1976 | Hansen | |
| 5,883,604 | A | 3/1999 | Nicely | |
| 6,278,411 | B1 | 8/2001 | Ohlsson et al. | |
| 6,469,676 | B1 | 10/2002 | Fehrenbach et al. | |
| 6,593,893 | B2 | 7/2003 | Hou et al. | |
| 6,717,553 | B2 | 4/2004 | Sasaki et al. | |
| 6,750,827 | B2 | 6/2004 | Manasson et al. | |
| 6,879,297 | B2 | 4/2005 | Brown et al. | |
| 6,972,726 | B2 | 12/2005 | Sato et al. | |
| 6,972,728 | B2 | 12/2005 | Brown et al. | |
| 6,992,639 | B1 | 1/2006 | Lier | |
| 7,286,095 | B2 * | 10/2007 | Parsche et al. | 343/773 |
| 7,379,030 | B1 | 5/2008 | Lier | |
| 2004/0201534 | A1 * | 10/2004 | Hagiwara | 343/773 |
| 2006/0092087 | A1 | 5/2006 | Lange | |
| 2006/0125706 | A1 | 6/2006 | Amyotte et al. | |
| 2008/0129595 | A1 | 6/2008 | Choi et al. | |

FOREIGN PATENT DOCUMENTS

| | | |
|---|---|---|
| DE | 3804118 | 9/1988 |
| GB | 2223360 | 4/1990 |
| WO | WO87/06066 | 10/1987 |

OTHER PUBLICATIONS

Institute of Electrical and Electronics Engineers (IEEE), IEEE Std 145-1993 (R2004) Standard Definitions of Terms for Antennas, p. 11, (Sep. 23, 2004).

Christopher Coleman, Basic Concepts: An Introduction to Radio Frequency Engineering, Cambridge Univ. Press (2004).

Philips, B.; Olver, A.D.; "Design and performance of profiled dielectric loaded horns"; *Microwaves, Antennas and Propagation, IEEE Proceedings*; Oct. 1994; vol. 141; Issue 5; p. 337-341; Electronics Laboratory, University of Kent; Department of Electronic Engineering, Queen Mary and Westfield College.

Orfanidis, Sophocles J.; *Electromagnetic Waves and Antennas* (e-book); Chapter 5, "Reflection and Transmission"; pp. 150-182: www.ece.rutgers.edu/~orfanidi/ewa; revised Feb. 14, 2008.

* cited by examiner

*Primary Examiner* — Shih-Chao Chen
(74) *Attorney, Agent, or Firm* — Christopher A. Monsey

(57) ABSTRACT

An apparatus, method of propagating a signal and method of manufacture for an antenna structure comprising a section which is positioned or formed in relation to a portion of the antenna structure, such that a portion of the electromagnetic (EM) field that is emitted from the antenna structure is partially slowed or phase shifted thereby resulting in an improvement of the horizontal gain of the EM field.

1 Claim, 9 Drawing Sheets

PRIOR ART

PRIOR ART

ANTENNA WITH SHAPED DIELECTRIC LOADING

The invention described herein may be manufactured and used by or for the Government of the United States of America for Governmental purposes without the payment of any royalties thereon or thereafter.

FIELD OF THE INVENTION

The invention relates generally to the fabrication and use of antenna systems used in transmitters and receiver systems. In particular, the invention concerns structures or portions of antenna structures used to shape emitted electromagnetic (EM) wave patterns as well as methods of manufacturing and use of the same.

BACKGROUND OF THE INVENTION

Increasing use of high frequencies in radio frequency systems has led to a need to modify and adapt existing antenna structures. Driving antennas at a higher frequency tends to affect directivity and thus affecting the effective range of antennas. As discussed in Christopher Coleman's Basic Concepts, An Introduction to Radio Frequency Engineering, Cambridge University Press (2004), in EM, directivity is a property of the radiation pattern produced by an antenna. Directivity is defined as the ratio of the power radiated in a given direction to the average of the power radiated in all directions; the gain pattern is the product of the efficiency of the antenna and the directivity.

For example, FIG. 1 shows an antenna, frequently called a discone antenna, composed of a disc 1, a frustum circular conic section structure 3, conductors 7 and a voltage source 9 with a throat or feed gap 5, typically connected in such a manner as to have an axis of rotational symmetry 15. FIG. 2A shows the FIG. 1 antenna with an axis of rotational symmetry 15 that is perpendicular to the disc 1 and runs through the center of the cone structure 3. Discone antennas provide azimuthally (defined as the plane orthogonal to the axis of symmetry of the antenna and parallel to the disc component of the antenna) omni-directional field (radiation intensity) patterns over broad frequency ranges.

FIG. 2B shows an exemplary omni-directional radiation pattern. In particular, FIG. 2B shows an antenna with an elevation pattern 13A that is substantially directed perpendicular to the axis of symmetry 15, having a direction of the peak magnitude 11 of the elevation pattern.

FIG. 2C shows an exemplary radiation pattern at a higher frequency where the resulting elevation pattern 13B is oriented away from the axis perpendicular to the axis of symmetry by an angle 17 greater than 90 degrees. The FIG. 2C radiation pattern shows a maximum radiation intensity oriented toward the cone portion of the antenna. The direction from the origin of the spherical frame of reference for the antenna through the peak of the intensity pattern is defined by a function of (□,□) here represented by direction of pattern peak vector 11 when the elevation pattern is not parallel with the plane of the disc component of the antenna. The included angle 19 defines the degree of flair for the cone from the lower portion of the axis of symmetry 15. If a discone antenna with the radiation pattern as represented in FIG. 2C were mounted on a vehicle, for example, the direction of pattern peak would increasingly be below the horizon as frequency was increased, thus reducing the range and effectiveness of such a discone antenna. Accordingly, there is a need for an improved antenna design which provides improved directional gain that also has a simple and highly durable design.

SUMMARY OF THE INVENTION

An apparatus and method of manufacture for an antenna structure comprising a section which is positioned or formed on a portion of the antenna structure, such that a portion of the EM field that is emitted from the antenna structure is partially slowed or phase shifted thereby resulting in an improvement of the horizontal gain of the EM field.

DETAILED DESCRIPTION OF THE INVENTION

Figure 1:
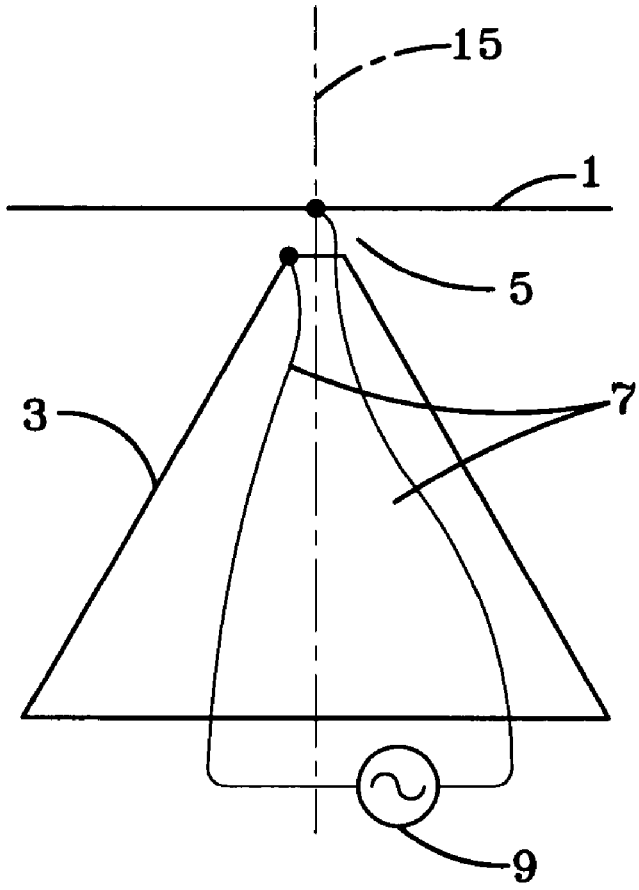
FIG. 1 shows an isometric view of a discone antenna.
Figure 2B:
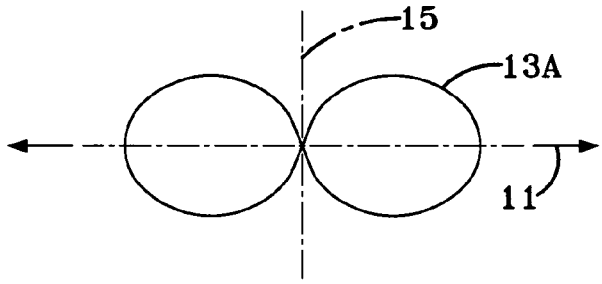
FIG. 2B shows an EM radiation pattern of the antenna shown in FIG. 2A at a first frequency.
Figure 2A:
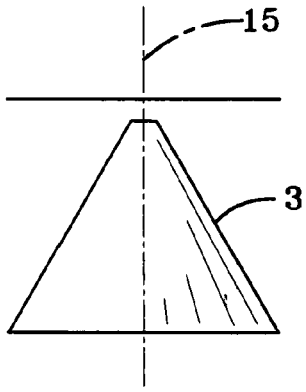
FIG. 2A shows a cross section of a discone antenna with a reference axis.
Figure 2C:
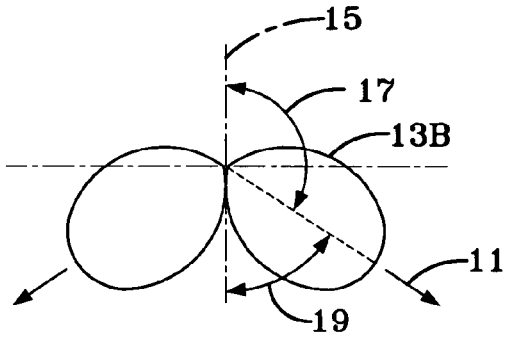
FIG. 2C shows an EM radiation pattern of an antenna shown in FIG. 2A at a second frequency.

An antenna or aerial is an arrangement of aerial electrical conductors designed to transmit or receive radio waves which is a class of EM waves. Physically, an antenna is an arrangement of conductors that generate a radiating EM field in response to an applied alternating voltage and the associated alternating electric current, or can be placed in an EM field so that the field will induce an alternating current in the antenna and a voltage between its terminals.

A radiation pattern is a graphical depiction of the relative field strength transmitted from or received by the antenna. Several curves or graphs are necessary to describe radiation patterns associated with an antenna. If the radiation of the antenna is symmetrical about an axis (as is the case in dipole, helical and some parabolic antennas) a unique graph is sufficient.

One definition of the term radiation pattern of an antenna is the locus of all points where the emitted power per unit surface is the same. As the radiated power per unit surface is proportional to the squared electrical field of the EM wave. The radiation pattern is the locus of points with the same electrical field. In this representation, the reference is the best angle of emission. It is also possible to depict the directivity of the antenna as a function of direction.

The "polarization" of an antenna can be defined as the orientation of the electric field (E-plane) of the radio wave with respect to the Earth's surface and can determined by the physical structure of the antenna and by its orientation. EM waves traveling in free space have an electric field component, E, and a magnetic field component, H, which are usually perpendicular to each other and both components are perpendicular to the direction of propagation. The orientation of the E vector is used to define the polarization of the wave; if the E field is orientated vertically the wave is said to be vertically polarized. Sometimes the E field rotates with time and it is said to be circularly polarized. Thus, a simple straight wire antenna will have one polarization when mounted vertically, and a different polarization when mounted horizontally. EM wave polarization filters" are structures which can be employed to act directly on the EM wave to filter out wave energy of an undesired polarization and to pass wave energy of a desired polarization. Polarization is the sum of the E-plane orientations over time projected onto an imaginary plane perpendicular to the direction of motion of the radio wave. In the most general case, polarization is elliptical (the projection is oblong), meaning that the antenna varies over time in the polarization of the radio waves it is emitting.

There are two fundamental types of antennas which, with reference to a specific three dimensional (usually horizontal or vertical) plane, are either omni-directional (radiates equally in all directions) or directional (radiates more in one direction than in the other). All antennas radiate some energy in all directions in free space but careful construction results in substantial transmission of energy in certain directions and negligible energy radiated in other directions. By adding additional conducting rods or coils (called elements) and varying their length, spacing, and orientation (or changing the direction of the antenna beam), an antenna with specific desired properties can be created.

Figure 3A:
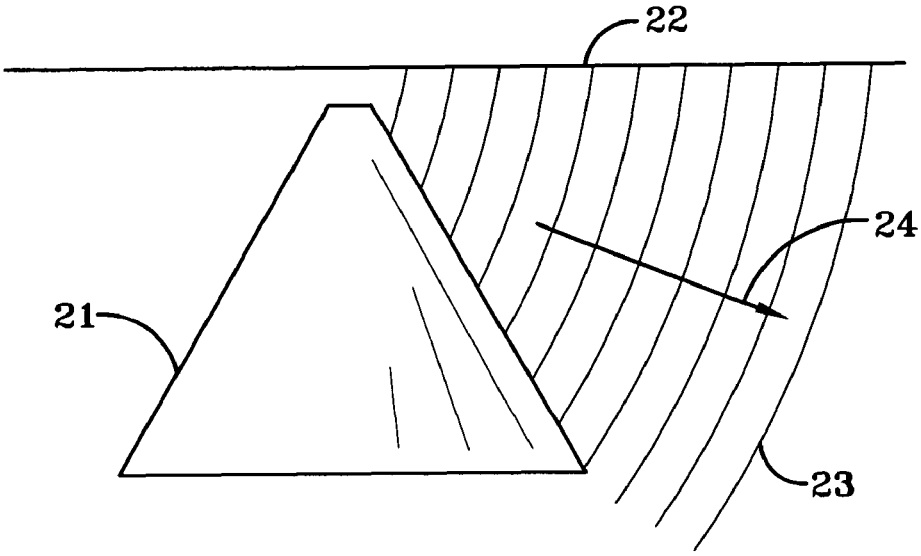
FIG. 3A shows a map of equal phase fronts and the associated poynting vector for an EM wave propagating through the structure of a discone antenna with the deflection associated with operation at higher frequencies.

Two or more antenna elements coupled to a common source or load produces a directional radiation pattern. The spatial relationship between individual antenna elements contributes to the directivity of the antenna as shown in FIG. 3A where the relationship of a disc 22 and a cone 21 influence the EM wave 23 propagation direction (poynting vector) 24. The term active element is intended to describe an element whose energy output is modified due to the presence of a source of energy in the element (other than the mere signal energy which passes through the circuit) or an element in which the energy output from a source of energy is controlled by the signal input.

EM waves can be shaped can be shaped by causing them to undergo propagation delays relative to free space propagation. EM waves are slowed relative to waves traveling through media or regions with relatively lower dielectric constants when passing through media or regions of space with high dielectric constants.

An isotropic antenna is an ideal antenna that radiates power with unit gain uniformly in all directions and is often used as a reference for antenna gains in wireless systems. There is no actual physical isotropic antenna; a close approximation is a stack of two pairs of crossed dipole antennas driven in quadrature. The radiation pattern for the isotropic antenna is a sphere with the antenna at its center. Peak antenna gains are often specified in dBi, or decibels over isotropic. This is the power in the strongest direction relative to the power that would be transmitted by an isotropic antenna emitting the same total power.

From IEEE Standard 145-1993 (2004): "Directivity (of an antenna) (in a given direction) is the ratio of the radiation intensity in a given direction from the antenna to the radiation intensity averaged over all directions." Equation 1 below provides the equation for directivity is as follows $$D(\phi, \theta) = \frac{4\pi\Phi(\phi, \theta)}{\Phi ave} \tag{1}$$

where $D(\phi,\theta)$ is the three space directivity magnitude function of the antenna defined over the radial coordinate system where the angle $\theta$ is measured down from the axis of symmetry and the angle $\phi$ is measured from and arbitrary plane including the antenna axis of symmetry; $\Phi(\phi,\theta)$ the radiation intensity (power radiated per unit solid angle) of the antenna defined over the same coordinate system as $D(\phi,\theta)$ and $\Phi ave$ is the global average of $\Phi(\phi,\theta)$ over all $\phi$ and $\theta$.

For passive antennas (those not including power amplifying components in their structure) directivity is a passive phenomenon—power is not added by the antenna, but simply redistributed to provide more radiated power in a certain direction than would be transmitted by an isotropic antenna. If an antenna has directivity greater than one in some directions, it must have less than one directivity in other directions since energy is conserved by the antenna. An antenna designer must take into account the application for the antenna when determining the directivity. High-directivity antennas have the advantage of longer effective range, but must be aimed in a particular direction. Low-directivity antennas have shorter range, but the orientation of the antenna is inconsequential.

A dielectric, or electrical insulator, is a substance that is highly resistant to electric current. When a dielectric medium interacts with an applied electric field, charges are redistributed within its atoms or molecules. This redistribution can alter the shape of an applied electrical field both inside the dielectric medium and in the region nearby. When two electric charges move through a dielectric medium, the interaction energies and forces between them are reduced. When an EM wave travels through a dielectric, its speed slows and its wavelength shortens.

Figure 3B:
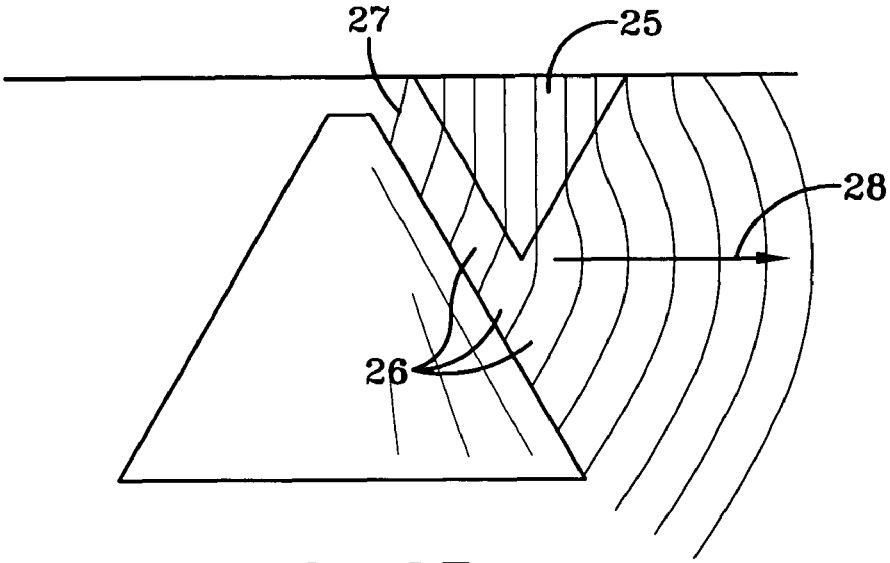
FIG. 3B shows a map of equal phase fronts and the associated poynting vector for an electro-magnetic wave propagating through the structure of a dielectrically loaded discone antenna with the attendant reduced deflection of the poynting vector associated with operation at higher frequencies.

Referring to FIG. 3B, the conjunction of regions, one with a relatively high dielectric constant, e.g., dielectric 25, and the other with a relatively lower dielectric constant, e.g., free space 26, can act as a refractor for an EM wave 27. The refractor, e.g., dielectric 25 and free space 26, alters the direction of propagation of the waves (poynting vector 28) emitted from the structure with respect to the waves impinging on the structure. It can alternatively bring the wave to a focus or alter the wave front in other ways, such as to convert a spherical wave front to a planar wave front. Thus a wave propagating mostly through a region with a high dielectric constant could travel slower than the lesser portion traveling through a region with a lower dielectric constant.

Figure 4:
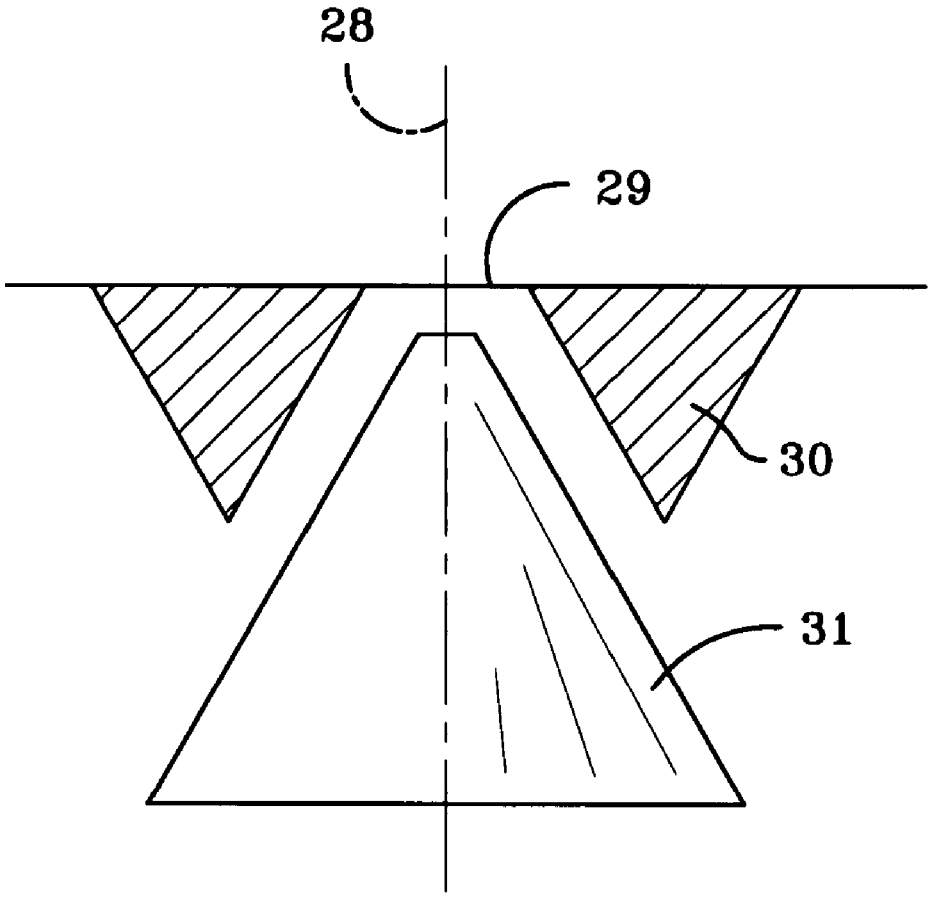
FIG. 4 shows an antenna with dielectric material for affecting wave propagation.

FIG. 4 shows one embodiment of the invention with a discone antenna comprising a disc 29 and a frustum circular conic structure 31 that are formed relative to an axis of symmetry 28 which is perpendicular to the planar surface of the disc 29. An annular structure of dielectric material 30 with a triangular cross section is formed onto the lower peripheral surface of the disc 29. The dielectric portion 30 design in this embodiment can be determined by varying its shape and dielectric composition so that, based on the desired frequency range, the overall EM field or radio frequency wave that is generated by the antenna in question is shifted towards the horizon. Effectiveness of the various shapes and compositions can be determined through modeling methods using modeling software that is commercially available or through empirical testing of the antenna designs using probe and test equipment. Having more dielectric material in the area of the disc side 29 causes the EM wave to travel slower along the direct surface path along the disc 29 due to the relatively higher dielectric property of the dielectric (as compared to another medium, in this case free space) causing a phase delay that pulls the EM wave (and therefore the field pattern peak) towards the plane of the disc 29. This effect is more pronounced as frequency is increased. The advantage of this design is that the direction of the peak directivity of the antenna is closer to or on the horizon for all or most of its frequency band. Moreover, the dielectric material may be changed to modify the pattern of an existing antenna.

Figure 5:
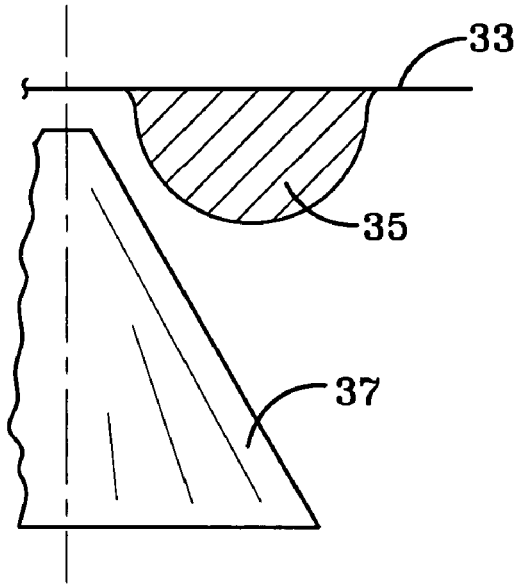
FIG. 5 shows another embodiment of the invention with a differently formed dielectric material.

Various solid shapes of dielectric can be utilized with a discone antenna design, either in contact or not in contact with the disc. Use of multiple layers or regions of dielectric material with differing dielectric constants can be used to reduce reflections at each dielectric interface and improve shaping of the elevation pattern. For example, FIG. 5 shows another embodiment of the invention where the dielectric material 35 has a smooth shaped surface with cross section in either the form of a circular segment or an elliptical segment formed on the periphery of the disc 33 but has a gap between the disc 33 and the frustum circular cone 37.

Figure 6:
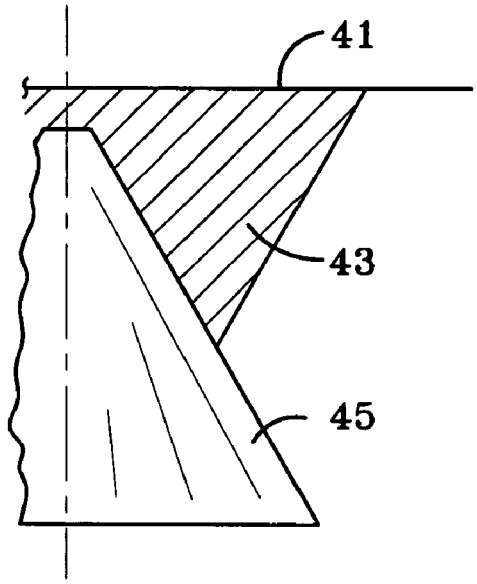
FIG. 6 shows another embodiment of the invention with another form for a dielectric material formed through the throat of a discone antenna.

FIG. 6 shows another embodiment where a dielectric 43 is formed in contact with disc 41 and a portion of the frustum circular cone 45.

Figure 7:
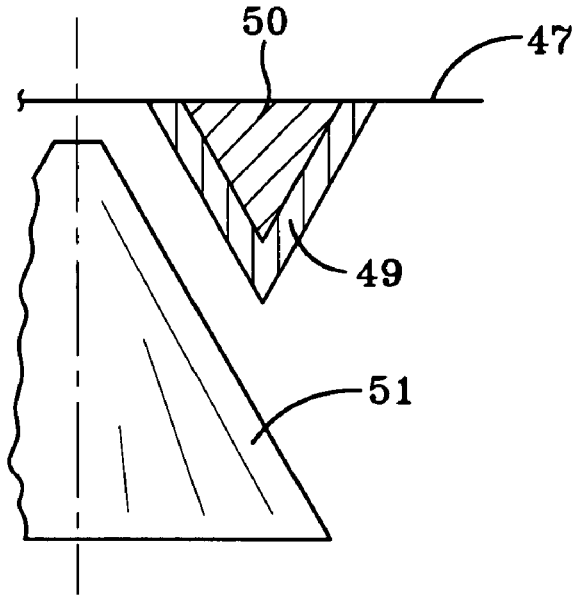
FIG. 7 shows another embodiment of the invention with a dielectric formed of a plurality of layers.

FIG. 7 shows another embodiment of the invention using a discone antenna structure comprising a disc 47 with layered dielectric materials 49, 50 are formed on an annular structure with a triangular radial cross section onto an outer periphery of disc 47 but not in contact with the circular cone section 51. Dielectric material 50 is first formed on the lower portion of the planar surface of disc 47 in a triangular cross sectional form. Dielectric material 49 is formed into a triangular form on the lower portion of the planar surface of the disc 47 so as to encapsulate dielectric material 50 forming a combined structure composed of two different dielectric materials 49, 50. The dimensions of the two layers 49, 50 are determined based on the effect that refractive properties of the two layers have on a portion of the EM field generated from the disc 47 and circular cone 51 antenna combination.

Figure 8:
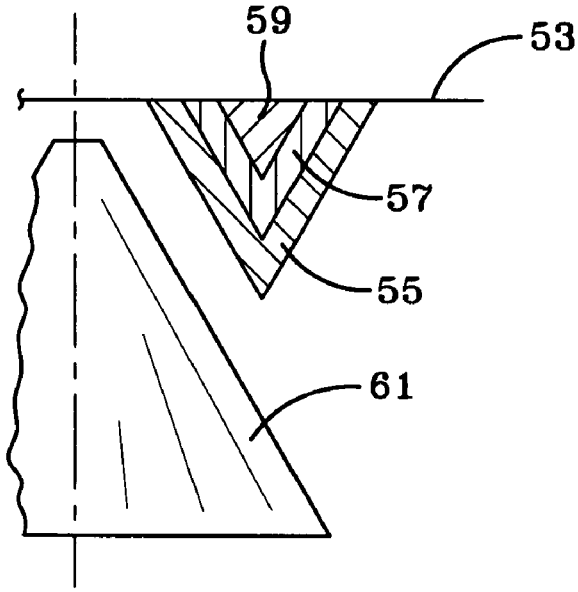
FIG. 8 shows another embodiment of the invention having a different plurality of layers.

FIG. 8 shows another embodiment of the invention where three dielectric layers 55, 57, 59 are formed as an annular structure with a triangular cross section onto the surface of the disc 53 facing the cone structure 61 of the discone antenna.

While a triangular shape is again used for the shape of the three dielectrics, one on top of the other, it should be noted that the invention in this case is not limited to this particular shape or placement on a disc of a discone antenna. Dielectric material can be placed in various portions of an antenna, such as a discone antenna. It is also possible to design an antenna using various shapes and dielectric materials as to achieve the desired effect on directional gain by placement of the phase shifting material on a portion of the antenna structure.

Figure 9:
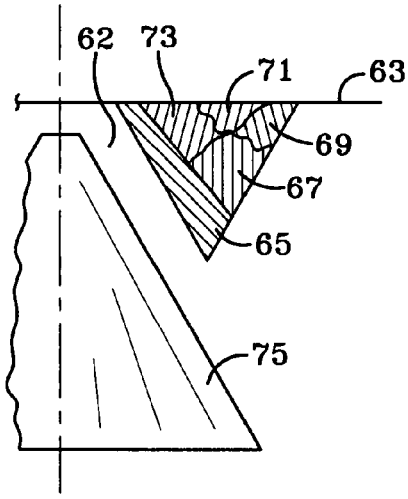
FIG. 9 shows another embodiment of the invention having a plurality of layers with different shapes.

FIG. 9 shows another embodiment of the invention where dissimilarly shaped dielectric layers 65, 67, 69, 71 and 73 form a composite structure having an outer shape of a triangular cross section which are used to adjust the refractive properties associated with phase shifting a portion of an EM wave to refract the EM wave in a predetermined direction. In this example, there is a gap 62 between the dielectric composite structure of dielectrics and the discone cone section 75. The composite structure of dielectrics can be formed in contact with a portion of the cone section 75. Multiple layers and irregularly shaped dielectrics permits reduction of reflections of the EM wave over an EM refractive boundary formed by two areas having a different dielectric constant. Accordingly, more than one layer is preferred if there is a need to increase EM energy in a preferred direction. Irregularly shaped layers are useful to further tune or mitigate reflections in a particular portion of the wave front.

Figure 10:
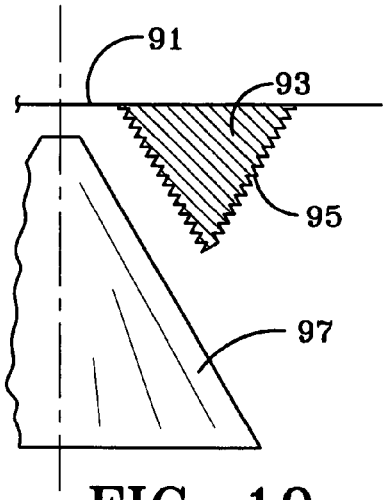
FIG. 10 shows another embodiment of the invention having at least one dielectric layer formed into a triangular cross section form with peripheral grooves.

FIG. 10 shows an embodiment where a dielectric material 93 is formed onto the disc 91 of the discone antenna structure with peripherally oriented grooves 95 cut into the outer surfaces of a dielectric material 93. The grooves and dielectric material is formed to affect the radiation pattern and propagation of the EM waves passing through the structure. Other variants of surface shaping can be used to alter wave forms and reduce reflections.

Figure 11:
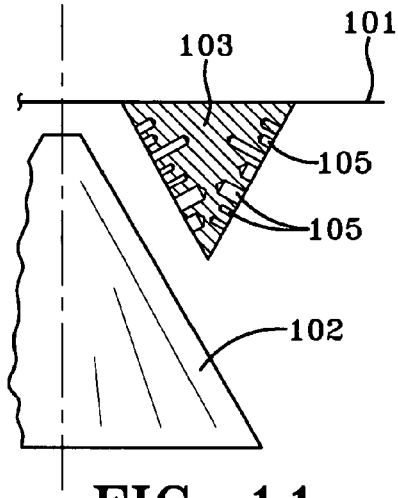
FIG. 11 shows another embodiment of the invention having surface features in a portion of an antenna including dielectric material formed with holes to further influence wave propagation through the dielectric material.

FIG. 11 shows another embodiment of the invention having dielectric material 103 formed on a surface of a disc 101 which is oriented towards a circular cone 102 of a discone antenna. In particular, the dielectric material 103 is formed with holes 105 which further influence wave propagation through the dielectric material 103. The holes 105 may be formed to varying depths and/or diameters in order to further tune wave propagation through the dielectric material 103. In this embodiment, the holes 105 are shown as being radially aligned, but need not be so aligned depending on the requirements of the implementation.

Figure 12:
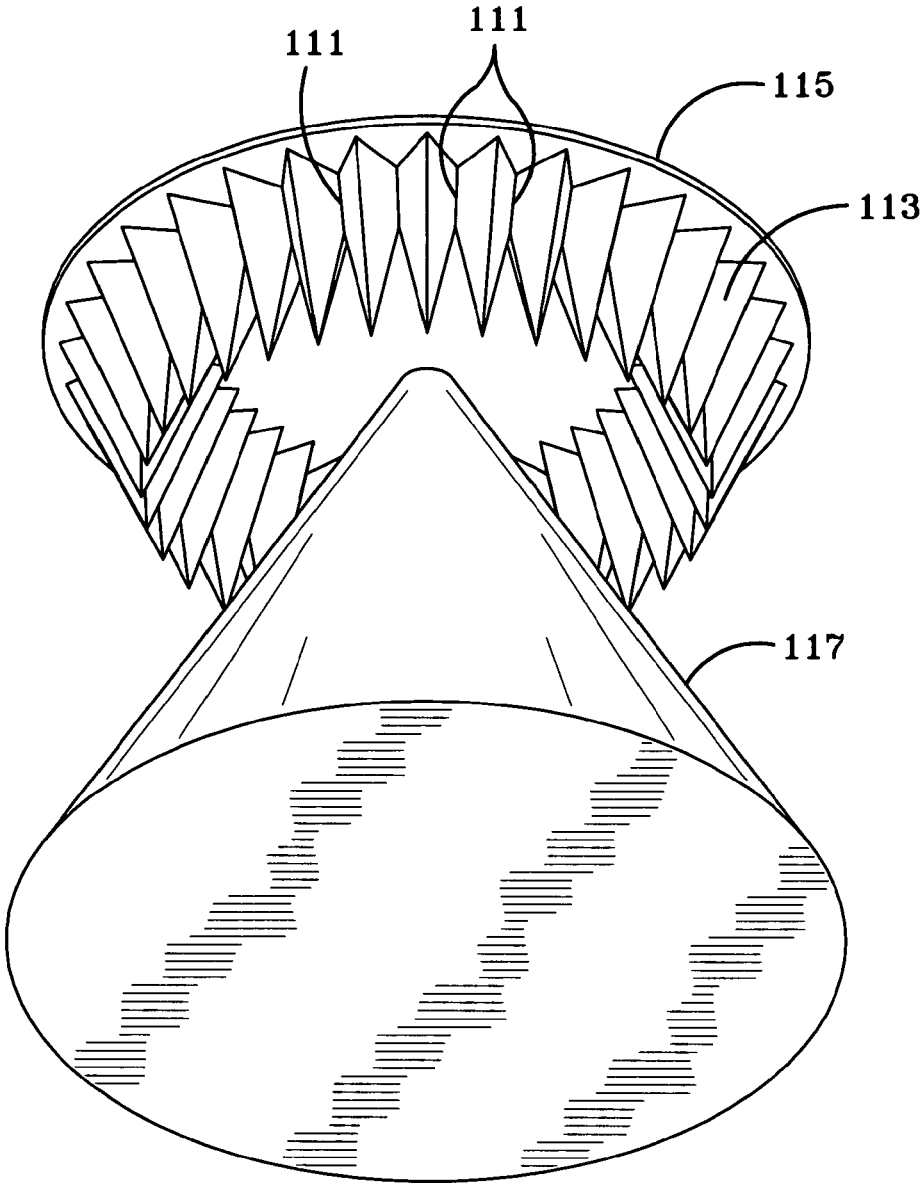
FIG. 12 shows an isometric view of another embodiment of the invention having a dielectric material formed into a triangular shape on a disc section of a discone antenna that is generally oriented towards a cone section of the discone antenna, where axial grooves are formed into two of the faces of the triangular shape.

FIG. 12 shows another embodiment of the invention with where a dielectric material 113 is formed onto an outer disc portion 115 of a discone antenna on the side oriented towards a frustum circular cone 117. The dielectric material 113 is formed into a triangular annular form with radial/axial grooves 111 formed onto two outer surfaces of the dielectric material 113 not in contact with the disc 115 forming "teeth like" protrusions. Other variants of surface shaping can be used to alter wave forms in a preferential direction and reduce reflections.

Figure 13:
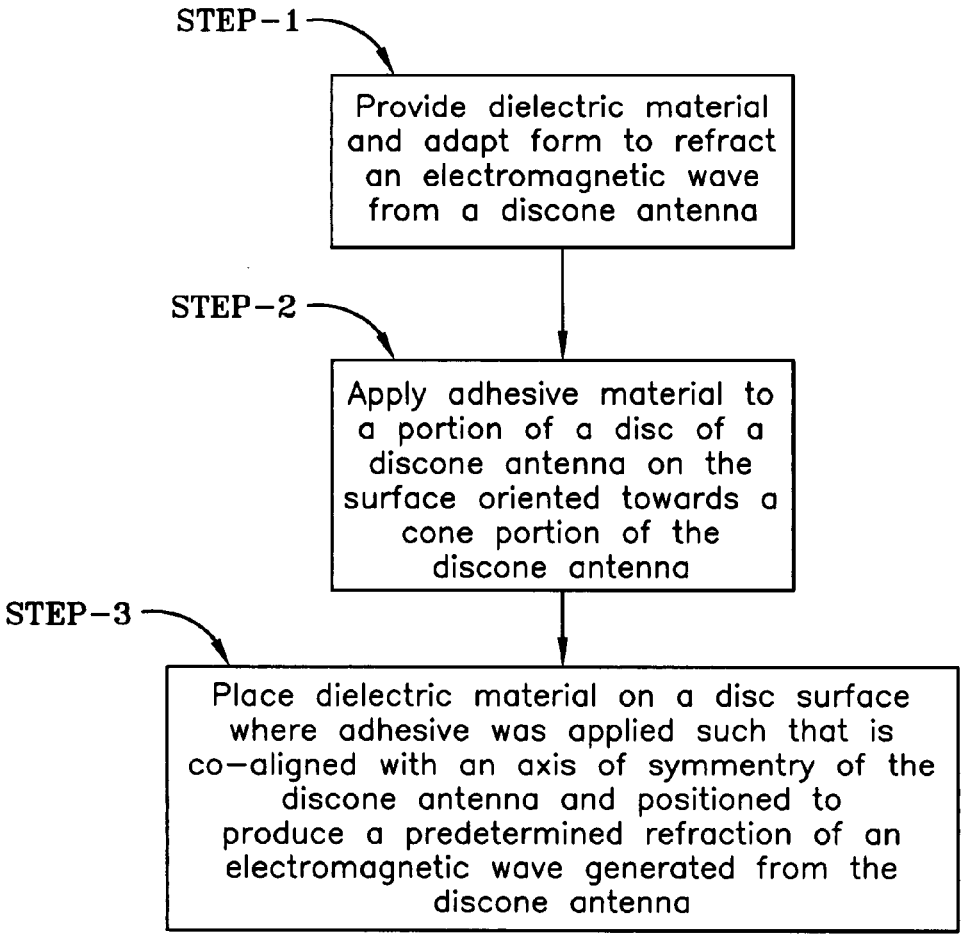
FIG. 13 shows an exemplary method of manufacture for one embodiment of the invention.

FIG. 13 shows one method of manufacture of an exemplary embodiment of the dielectric loaded discone antenna. At step 1, a dielectric material is provided and adapted to refract a portion of an EM wave generated from a discone antenna such that the wave front of the EM wave propagates in a predetermined direction upwards towards a plane that contains a disc portion of a discone antenna to produce an annular dielectric component. It should be noted that the dielectric material formed in this case will always refract an EM wave but more refraction will occur at higher frequencies. At step 2, an adhesive material is applied to a portion of the disc of the discone antenna oriented towards the frustum circular cone of the discone antenna. At step 3, the annular dielectric component is placed on the surface of the disc of the discone antenna oriented towards the frustum circular cone portion of the discone antenna and co-aligned along the axis of symmetry of the discone antenna and attached with the adhesive previously applied to the disc. Placement in this embodiment is accomplished to position the dielectric material to refract EM waves in a predetermined direction. It should be noted that any means can be used to couple the dielectric component to the discone antenna which will allow joining of the two components. Alternatively the dielectric material could be deposited upon the disc by a variety of deposition methods to achieve rough form and subsequently machined to its final shape. Added layers could subsequently be deposited upon or attached to disc and dielectric as required. The figure shows a triangular shape of the dielectric material however the actual surface shape of the dielectric material can be added to produce a desired change in directivity of an EM wave produced by passing an EM wave through a dielectric.

It should be noted that, while exemplary embodiments of the invention have been described and illustrated, the present invention is not to be considered as limited by such descriptions and illustrations but is only limited by the scope of the appended claims.

What is claimed is:

1. An antenna structure comprising:

a first antenna element, said first antenna element being adapted to produce a first electromagnetic radiation pattern comprising a first and second reference axis; and a second antenna element, said second antenna element comprising a material adapted to refract a portion of said first electromagnetic radiation pattern to produce a second electromagnetic radiation pattern which has a third reference axis being substantially orthogonal to said first reference axis;

wherein said second antenna element comprises a plurality of layers having an outer layer formed with a plurality of recesses formed within a face of the outer layer adapted to refract said first electromagnetic radiation pattern in a predetermined direction.

* * * * *